United States Patent [19]

Hershey et al.

[11] 4,154,899

[45] May 15, 1979

[54] PRODUCTION OF POROUS, SMOOTH, COATED PAPER USING HIGH SOLIDS WATER-BASED COATING COMPOSITIONS IN BLADE COATING APPARATUS

[75] Inventors: Robert V. Hershey, Brainerd; Gerald M. Hein, Cloquet, both of Minn.

[73] Assignee: Potlatch Forests, Inc., San Francisco, Calif.

[21] Appl. No.: 411,342

[22] Filed: Nov. 1, 1973

Related U.S. Application Data

[63] Continuation-in-part of Ser. No. 197,174, Nov. 5, 1971, abandoned.

[51] Int. Cl.[2] ..... B32B 9/06; B05D 3/12

[52] U.S. Cl. ..... 428/537; 427/209; 427/356; 427/361; 427/364; 427/365; 427/358; 428/538

[58] Field of Search ..... 117/111 F, 111 H, 111 R, 117/155 UA, 156, 157; 427/356, 361, 364, 365, 209; 428/537, 538

[56] References Cited

U.S. PATENT DOCUMENTS

| | | | |
|---|---|---|---|
| 2,534,320 | 12/1950 | Taylor | 117/111 R X |
| 2,700,621 | 1/1955 | Schwalbe et al. | 117/156 X |
| 2,874,066 | 2/1959 | McLaughlin et al. | 117/155 UA X |
| 3,028,258 | 4/1962 | Rice | 117/155 UA X |
| 3,351,479 | 11/1967 | Fairchild | 117/156 X |
| 3,392,048 | 7/1968 | Rolik | 117/156 X |
| 3,415,671 | 12/1968 | Rice | 117/156 X |
| 3,477,871 | 11/1969 | van Westrenen | 117/156 X |
| 3,477,970 | 11/1969 | Beeman | 260/17 R |
| 3,489,592 | 1/1970 | Wallsten | 117/111 R X |
| 3,578,493 | 5/1971 | Smith | 117/156 X |
| 3,713,881 | 1/1973 | Akiyama | 117/156 |

*Primary Examiner*—Ronald H. Smith
*Assistant Examiner*—Stuart D. Frenkel
*Attorney, Agent, or Firm*—Merchant, Gould, Smith, Edell, Welter & Schmidt

[57] ABSTRACT

The process of producing a porous, smooth, easy finishing coated paper utilizing high solids water-based coating compositions (e.g. 68–73% solids) having certain rheological and viscosity characteristics in blade coating apparatus on paper webs moving at speeds above 500 feet per minute (e.g. moving at 1500 to 3500 feet per minute). The coating compositions are substantially free of protein adhesives and contain clay as a coating pigment.

19 Claims, 1 Drawing Figure

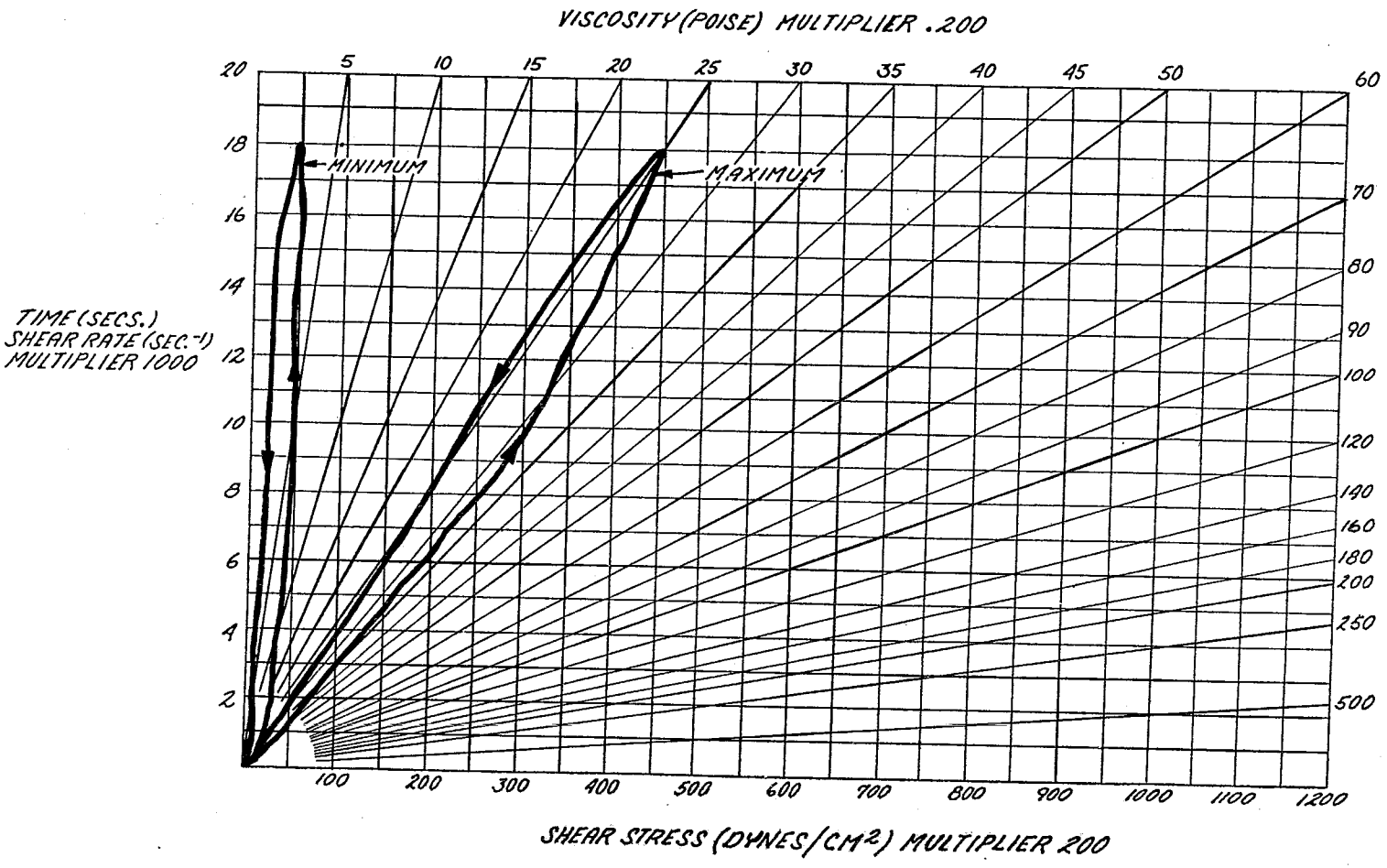
VISCOSITY (POISE) MULTIPLIER .200
SHEAR STRESS (DYNES/CM²) MULTIPLIER .200
TIME (SECS.)
SHEAR RATE (SEC.⁻¹)
MULTIPLIER 1000
MAXIMUM
MINIMUM
60
50
45
40
35
30
25
20
15
10
5
70
80
90
100
120
140
160
180
200
250
500
1200
1100
1000
900
800
700
600
500
400
300
200
100
20
18
16
14
12
10
8
6
4
2

PRODUCTION OF POROUS, SMOOTH, COATED PAPER USING HIGH SOLIDS WATER-BASED COATING COMPOSITIONS IN BLADE COATING APPARATUS

CROSS-REFERENCE TO RELATED APPLICATION

This application is a continuation-in-part of our copending application Ser. No. 197,174, filed Nov. 5, 1971 now abandoned.

BACKGROUND OF THE INVENTION

Paper mills coat moving paper webs with coating compositions to achieve various desired properties in the finished paper (e.g. printability, moisture resistance, and the like).

The techniques for applying coating compositions to paper vary. One of the more common and simplest methods of application of coating compositions to moving paper webs in paper mills is by the use of blade coaters, such as the trailing blade coater.

When blade coating was first developed into a practical method of applying aqueous coatings to paper and paper-board, it soon became apparent that scratches in the finished product were a major obstacle to be overcome if the blade coater was to become a commercial success. While many factors contribute to blade scratches, one major factor within the control of the paper mill was coating solids. In most cases, reducing the percent solids at which the coating was applied reduced the frequency of blade scratches and made the compositions less viscous and easier to handle and apply.

The design of a suitable coating composition is often difficult because, in many instances, the desired end properties in the coated paper appear to be almost mutually exclusive. By this it is meant that as one desired property is improved by changing the coating compositions or other coating parameters, the other desired property is diminished. Consequently, coating compositions in commercial use are the product of compromise.

In spite of this, the use of liquid coating compositions in blade coating apparatus has become one of the most widely used coating techniques. However, when higher quality paper products are desired special processes, compositions and apparatus are often used in combination (e.g. the use of highly polished chromium-plated drums to impart high gloss and surface smoothness to coated paper). These special techniques are often effective, but tend to be costly and often require the use of apparatus other than the blade coating apparatus used for making many common grades of coated paper.

In view of the widespread use of blade coating apparatus, various attempts have been made to utilize such equipment in combination with other techniques to achieve certain desired properties in coated paper such as porosity, smoothness, and the like. Such techniques include: (1) the use of blade coating techniques followed by brushing or supercalendering (e.g. supercalendering through 5–8 nips under pressure); (2) increasing the coating weight; and (3) using multiple coatings. However, each of these procedures has its own disadvantages (e.g. supercalendering smoothes the paper while densifying or compacting it (which is undesirable for some significant commercial purposes).

Accordingly, there is a need for means to be devised whereby blade coating apparatus (e.g. inverted blade coaters) can be used to produce improved coated paper (e.g. improved as to smoothness, ease of finishing, porosity, and the like). Such a procedure would eliminate the need for multiple types of coating apparatus and the related investment. Further, it would reduce the cost of making such products. Desirably, such a procedure will be effective at relatively low coating weights and will produce useful improvements in a single pass (i.e. avoid the use of multiple coatings on each side of the paper web). Further, such a procedure should utilize a substantial amount of clay pigment (as a percent of total pigment).

SUMMARY OF THE INVENTION

The present invention is based upon the discovery that paper webs can be successfully coated at relatively high web speeds using conventional blade coating apparatus in combination with high solids aqueous coating compositions which have certain rheological and viscosity characteristics. Unexpectedly, the properties of the resulting coated paper are enhanced in an unexpected manner. One of the most significant unexpected combination of properties observed to date is the combination of increased smoothness combined with increased porosity at a given coat weight (both characteristics are desired in paper used for printing, particularly for web off-set printing). Further, the resulting paper is easy finishing, even when coated at low coating weights in a single pass.

The coating compositions used in the present process are aqueous coating compositions having a total solids level of at least 67% by weight, preferably at least 68% by weight, desirably within the range of 68–73% by weight (e.g. about 70% by weight). These compositions contain conventional paper coating pigments (generally of the non-photoconductive type) and one or more non-protein adhesives, the total amount of which is usually 7–25 parts (on a dry basis) per 100 parts of pigment (dry basis). At least one-third of the pigment will be clay. A typical adhesive is a mixture of starch and butadiene/styrene polymer (used as a latex).

THE DRAWING

The drawing is a rheogram illustrating the maximum and minimum desired rheology of the coating compositions used in the present process.

DETAILED DESCRIPTION

The Process

The process of the present invention involves passing a paper web at a speed of at least 500 feet per minute past a blade coating station. Desirably, the web speed is over 1,000 feet per minute, frequently within the range of 1,500 to 3,500 feet per minute.

The blade coating station can be any of a variety of commonly used blade coating machines (e.g. either an inverted or a puddle blade coater). In such apparatus, the aqueous coating composition is contacted with the moving paper web and the resulting wet coating composition is leveled and metered by a blade (usually metal) positioned transverse or across the moving web. Typically, the blade is contacted with the paper under pressure, thereby forcing the paper web against a backing roll (e.g. a steel cylinder covered with a resilient surface such as rubber). Blade thicknesses from 0.010 inches to 0.050 inches are commonly used (e.g. 0.015 inches to 0.040 inches thick). Various blade designs are known and flexible blades are sometimes used in combination with stiff or rigid backing blades.

After the paper web passes the blade coating station, the wet coating composition is dried (e.g. by means of heated air).

For printing purposes, it is common to coat both sides of the paper by means of two coating stations or, less commonly, by completely coating one side of a roll of paper and then inverting the roll and coating the other side of the paper, all at the same coating station.

Typical coating weights (per each side of the coated paper) are from 3–12 lbs. of coating per ream of paper (3300 square feet per ream). The weight of the paper before coating (i.e. the base stock) can vary considerably, depending upon the end use desired. Typically, the base stock will have a weight of 20–180 lbs. per ream (e.g. 40–130 lbs. per ream). Usually the base stock will be of a fibrous nature and can be of rag, wood or synthetic fiber origin. If desired, continuous plastic webs capable of being blade coated may be used. The base stock can be and preferably is sized or prime coated.

The aqueous coating compositions

The coating compositions used in the present process are aqueous coating compositions containing a total solids level of at least 67% by weight, preferably at least 68% by weight, desirably having a total solids level within the range of 68–73% by weight. A solids level of about 70% appears optimum for coating compositions based on a mixture of latex (e.g. butadiene/styrene polymer) and starch adhesives. However, higher solids levels can be used (e.g. 75–80% by weight) provided the parameters hereinafter set forth are met.

These coating compositions contain paper coating pigments which are selected for their printing properties (i.e. they are used for graphic arts printing and not electrostatic printing). Consequently, the use of substantial amounts of photo-conductive pigments (e.g. a photo-conductive grade of zinc oxide pigment) are not contemplated for use in the compositions of the present invention.

At least one-third of the total pigment present will be clay. This is advantageous in many respects including the avoidance of problems (e.g. tendency to mark and poor ink holdout) associated with the use of large amounts (e.g. 90%) of other pigments (e.g. calcium carbonate). Desirably, at least 90% of the pigments contained in the coating compositions will be selected from the group of coating grade pigments consisting of clay, calcium carbonate, titanium dioxide, hydrated alumina, barium sulphate and ground limestone. For many applications, the use of kaolin clay pigment is particularly desirable and, in such instances, it is preferred that the kaolin clay account for from about 40% to 100% of the total weight of pigment in these coating compositions. For most printing purposes, at least 80% by weight of the pigments present in these coating compositions should have a particle size smaller than 2 microns (equivalent spherical diameter as determined by settling techniques). A number 2 grade kaolin coating clay is effective. Such a product has a flat plate-like structure and produces paper which is easy to gloss and prints well.

The commercially preferred number 2 grade is "KCS" grade, which is at least 80% by weight less than 2 microns in particle size, equivalent spherical diameter (esd). This degree of fineness corresponds roughly to the "standard machine coating" grade described in TAPPI Monograph No. 30, *Paper Coating Pigments*, Mack Printing Co., Easton, Pa., 1966, pages 72–87. This grade is more than 95% wt. % below 5 microns, (esd) and almost 60% below 1 micron, (esd); thus the average size is well below 2 microns, esd. As pointed out by the TAPPI monograph at pages 72 and 77, the kaolin particles smaller than 2 microns (esd) are generally in the form of thin hexagonal plates (or small aggregates of plates) with a width or diameter which is several times (e.g. about 10 times) the thickness. Even the small aggregates have an "aspect ratio" (see U.S. Pat. No. 3,578,493 to Smith, column 4, line 45 et seq.) well above the 1:1 to 3:2 range which characterizes the nearly spherical pigments. According to the TAPPI monograph, page 77, the natural kaolin particles larger than 2 microns (esd) typically are strongly bound laminates which are more isometric than plate-like or lammellar.

As pointed out previously, clay (e.g. kaolin) and plate-like or lammellar particles are not the only coating grade pigments useful in this invention. Non-lammellar (i.e. non-platy) particles and non-clay lammellar particles are useful; particularly if they have sufficient fineness, e.g. and average esd below 2 microns, e.g. 1.5 microns or less. Typically, these fine pigments are (as noted by Smith U.S. Pat. No. 3,578,493 in column 2, line 20 et seq) 60–100% by weight less than 1 micron (esd) in particle size and include such materials as titanium dioxide, precipitated calcium carbonate, precipitated barium sulfate, and the like. Hydrated alumina tends to have a particle size distribution somewhat similar to coating grade kaolins (i.e. at least 80% by weight less than 2 microns, esd) and can also be plate-like in nature. Representative examples of low aspect ratio pigments and coarse pigments (averaging above 2 microns, esd) are well illustrated in the aforementioned Smith patent. For coating of high grade (e.g. offset grade) paper according to this invention, it is preferred to substantially exclude coarse pigments, particularly the nearly spherical or non-clay coarse pigments. To facillitate coating at especially high solids levels (e.g. 70–80 wt. %) elimination of the starch component and addition of a small amount (e.g. up to about 15 or 20% by weight of the total pigment material) of coarse pigment (e.g. ground limestone, ground barytes, etc.) is helpful and does not involve any departure from the maximum and minimum rheology characteristics of this invention, provided the pigments composition and the latex are properly selected. These high solids levels (e.g. 72–75 wt. %) are particularly useful with heavy paper products with a 500 sheet ream weight above 80 pounds, e.g. bleached paperboard and other printable food packaging materials.

The coating compositions will also contain one or more adhesives or binders together with various optional ingredients.

A variety of adhesives can be used, provided the resulting compositions have the desired rheological and viscosity properties as hereinafter set forth. Typical water soluble or water dispersible adhesives include modified and unmodified starches such as hydroxyethylated starch ether, styrene/butadiene polymers, polyvinyl alcohols, vinyl chloride polymers, vinyl acetate polymers, acrylic polymers (e.g. from such monomers as acrylate and methacrylate esters, styrene, etc.) and other nonprotein adhesives. Most protein adhesives (e.g. casein or soya protein) have not been found acceptable for use in the compositions of the present invention (in other than very minor amounts not exceeding one part by weight per 100 parts of pigment) because of their tendency to substantially increase the viscosity of coating compositions formulated to high solids levels (e.g. formulated to within the range of 68–73% solids) and because of their undesirable effect on high shear rheology. A particularly effective combination of adhesives for use in these compositions is a mixture of butadiene/styrene polymer (used as a latex) and starch wherein the amount of starch present is less than the amount of butadiene/styrene polymer used. Desirably, compositions used in the present invention will be free of protein adhesives.

In general, the amount of non-protein adhesive used in the compositions of the present invention will be from 5–30 parts (e.g. 7–25 parts) of water dilutable adhesive (on a dry or solids basis) per 100 parts by weight of pigment (dry basis). In this respect, the pigment or mixture of pigments will be the major ingredient in the present coating compositions (aside from the water that is present). Accordingly, it is convenient to relate the amount of adhesives and other optional additive ingredients to the amount of pigment used.

As previously indicated, the present process contemplates the use of what are considered, in a commercial paper coating sense, high solids coating compositions. It is true that prior art patents contain disclosures of numerous coating compositions wherein it is suggested that these coating compositions could be used at higher solids levels. However, such compositions which contain significant amounts of clay pigment with substantially the balance being some other fine coating grade pigment are not (to our knowledge) used in commercial blade coating operations in the manner and at the high solids levels herein described, but rather are used at generally lower solids levels (e.g. 60–65% solids) for reasons hereinbefore given (e.g. viscosity considerations). We have found that if one increases the solids level of our aqueous coating compositions over 67%, preferably within the range of 68–73% by weight, and then selects only those resulting compositions having a viscosity at these high solids levels within the ranges hereinafter specified and further having a rheology at these high solids levels equal or between the minimum and maximum rheologies as hereinafter specified and as shown in the Drawing, the resulting compositions (i.e. the selected group) can be efficiently applied in blade coating apparatus to paper webs moving at high speeds (e.g. 1500–3500 feet per minute) and the resulting coated paper has properties which are unexpected in view of the knowledge of the properties of the paper coated with the same compositions when diluted to a lower solids content (e.g. diluted to 62% solids). This is particularly pronounced and advantageous in manufacturing paper for use in graphic arts printing. Paper coated according to the present process shows improvements in porosity, levelness, smoothness, and ease of finishing. For example, paper coated according to this invention in one pass (i.e. without plural coatings) can be used uncalendered to give a matte finish, can be lightly calendered to provide a high bulk paper, or supercalendered to get a smooth, high gloss, porous enamel suitable for web offset printing.

The temperature of application of the coating to a moving paper web is not critical and can range from 20°–80° C., more usually within the range of 40°–60° C. As known in the art, the temperature of application is frequently varied in commercial operations to compensate for certain variables such as the viscosity of the coating composition.

The two critical factors to be determined in selecting a coating composition for use according to the present invention are viscosity and rheology, all as hereinafter described. For purposes of convenience, it is useful to prepare each coating formula under consideration at various levels of dilution (e.g. 74% solids, 72%, 70% and 68%) and then determine both viscosity and rheology on each solids level. With some formulas, none of the high solids coatings (i.e. 67% or above) will meet the viscosity and rheology criteria. With others, satisfactory viscosity and rheology may be reached at solids levels of, for example, 68% and below, only. However, with others, satisfactory viscosity and rheology may be present over a wide range of solids levels (e.g. 68–72%). In any event, it has been found that satisfactory results are obtained only if one uses an aqueous coating composition at a solids level of at least 67%; at which level the viscosity and rheology are within the ranges herein set forth.

The viscosity of aqueous coating compositions used according to the present process, when measured at the solids level of anticipated use, should be within the range of 1,000–30,000 cps as measured on a Brookfield viscometer, LVF, No. 5 Spindle, at 20 rpm and 122° F. (50° C.). More desirably, the viscosity (measured in the same manner) should be within the range of 3,000–18,000 cps.

The rheology of these aqueous coating compositions, when measured by a Ferranti-Shirley Cone & Plate Viscometer at 100° F. (i.e. 37.8° C.) at the solids level of anticipated use should equal or fall between the maximum and minimum desired rheology as shown by the curves of the Drawing and as set forth in the numerical description of curves as shown in Table I. Test conditions include the use of a spring constant of 2305, a two centimeter cone, a sweep of 40 seconds, a scale reading of 2 X, a switch position of 1,000, and a temperature of 100° F.

TABLE I

| | Shear Stress Dynes/cm$^2$ | Shear Rate Sec −1 |
|---|---|---|
| MAXIMUM Desired Rheology | | |
| Up Swing | 90,000 | 18,000 |
| | 78,000 | 14,000 |
| | 62,000 | 10,000 |
| | 42,000 | 6,000 |
| | 16,000 | 2,000 |
| Down Swing | 90,000 | 18,000 |
| | 68,000 | 14,000 |
| | 50,000 | 10,000 |
| | 32,000 | 6,000 |
| | 12,000 | 2,000 |
| OPTIMUM Desired Rheology | | |
| Up Swing | 42,000 | 18,000 |
| | 39,000 | 14,000 |
| | 34,000 | 10,000 |
| | 24,000 | 6,000 |
| | 13,000 | 2,000 |
| Down Swing | 42,000 | 18,000 |
| | 34,000 | 14,000 |
| | 24,000 | 10,000 |
| | 16,000 | 6,000 |
| | 6,000 | 2,000 |
| MINIMUM Desired Rheology | | |
| Up Swing | 10,000 | 18,000 |
| | 10,000 | 14,000 |
| | 10,000 | 10,000 |
| | 9,000 | 6,000 |
| | 6,000 | 2,000 |
| Down Swing | 10,000 | 18,000 |

TABLE I-continued

| Shear Stress Dynes/cm$^2$ | Shear Rate Sec −1 |
|---|---|
| 3,000 | 14,000 |
| 5,000 | 10,000 |
| 2,000 | 6,000 |
| 1,000 | 2,000 |

Test Methods

Unless otherwise indicated, all test results referred to herein are determined according to the currently applicable TAPPI or equipment manufacturers standard methods, as appropriate.

(a) Viscosity

A model RVF Brookfield Synchro-lectric Viscometer was used for all measurements. A No. 5 Spindle at 20 rpm was the standard setting used unless otherwise specified. All laboratory viscosity measurements were made at 122° F. (50° C.). The Brookfield Viscometer measures viscosity by measuring the force required to rotate the spindle in the coating. All references herein to "viscosity" refer to Brookfield viscosity.

(b) Rheology

Rheology is defined as the behavior of fluids under shear. High shear rheograms were automatically plotted using a Ferranti-Shirley Cone and Plate Viscometer. The method used was that set forth in the "Operating Handbook", Ferranti Bulletin No. B/12587-113, Ferranti-Shirley Viscometer System, Ferranti Electric, Inc., Plainview, N.Y., 11803.

(c) Application of the Coating to the Paper

All paper coated at high speed was coated by an inverted blade coater (manufactured by Rice Barton Corporation).

All laboratory samples of coated paper were prepared on a Time-Life coater. Time-Life coaters are manufactured by John. Thew, 16 Apple Tree Trail, Westport, Conn. 06880.

(d) Conditioning

All samples were conditioned (prior to testing) in accordance with TAPPI Standard T 402 os-70.

(e) KBB Size

TAPPI Routine Control Method RC-69.

(f) Porosity (Gurley)

TAPPI Standard T 460 os-68.

(g) Caliper

TAPPI Standard T 411 os-68.

(h) Brightness (G.E.)

TAPPI Standard T 452 m-58.

(i) Opacity

TAPPI Standard T 425 m-60.

(j) Smoothness (Bekk)

TAPPI Standard T 479 sm-48.

(k) Surface Strength (IGT Pick)

TAPPI Standard T 499 su-64.

(l) Specular Gloss at 75°

TAPPI Standard T 480 ts-65.

(m) Blue Ink Gloss

Specular gloss at 75° as measured on a coated paper sample which has been printed with blue ink according to a standardized procedure.

(n) K&N Ink Absorptivity

TAPPI Routine Control Method RC-19.

(o) Blister Resistance

Blister resistance was measured using a West Linn Blister Tester (Serial No. 110) according to the manufacturer's instruction booklet. The West Linn Blister Tester is manufactured by West Linn Products Co., Lake Oswego, Oreg.

Examples 1-4 relate to experiments conducted on commercial scale blade coating equipment while Examples 5-10 relate to laboratory experiments. With regard to Examples 1-4, it should be noted that there is in commercial scale operations some accidental dilution of aqueous coatings although this is ordinarily nominal. However, solids level as well as coating temperature and blade pressure are variables that can be changed in the plant to improve runnability, alter coat weight, etc. For example, there is a short dwell time between the point of application of a coating composition to a base sheet before contact with the blade. The change in solids content of the coating carried by the base sheet during this short time is a function of the openness or water absorbing properties of the base stock. Consequently, to obtain a given solids level immediately under the blade, it is sometimes necessary or desirable to adjust the solids at the point of application (usually by dilution) to compensate for differences among base sheets. Blade pressures above 3.6 pounds per lineal inch (pli), desirably over 5.0 pli are used in conjunction with the high solids coatings in the present process.

EXAMPLE 1

This example illustrates the preparation of a heavily supercalendered high-gloss enamel paper for use in sheet fed offset printing.

An aqueous composition was prepared by conventional procedures from the following ingredients to a total solids level of 71% (after screening). The pH was 7.4 and the viscosity was 9,000 cp. at 129° F.

| Materials | Dry Parts (by weight) |
|---|---|
| Pigments | |
| Kaolin clay (a 90 brightness, No. 1 grade coating clay) | 50 |
| Calcium carbonate (precipitated) | 50 |
| Adhesives | |
| Styrene butadiene copolymer[1] | 12 |
| Hydroxyethylated starch ether (such as Penford Gum 290) | 2 |
| Additives | |
| Lubricant (such as triglycerides of animal fat acids) | 1.67 |
| Clay dispersant (tetrasodium pyrophosphate) | 0.05 |
| Carbonate dispersant (sodium hexametaphosphate) | 0.5 |
| Antifoamers and defoamers less than | 0.3 |

[1]A commercially available, carboxylated latex such as supplied by the Dow Chemical Company.

The rheology of this coating composition fell between the maximum and minimum curves as shown in the drawing.

The coating composition was experimentally used to coat 55 pounds per ream (3300 square feet) prime coated base stock on both sides in one pass by means of an inverted blade coater having two blade coating stations. The web speed was about 1600 feet per minute. Samples were taken of the coating composition at each of the two coating stations. The sample at the first coating station had a solids level of 68.2%, a pH of 7.4 and a viscosity of 4,200 cp. at 129° F. The solids level at the second coating station was 69.9% and the pH was 7.4. The blade thickness at both coating stations was 0.020 inches. The blade pressure at the first coating station was about 6.35-6.75 lbs. per lineal inch and the blade pressure at the second coating station was 5.65–6.0 lbs. per lineal inch. The paper had a coated weight of 72 lbs. per ream.

The resulting coated paper was smooth, porous and easy finishing. It was finished by supercalendering (8 nips under pressure) to form a high-gloss enamel paper. The paper was subsequently test printed by sheet fed offset methods. In this regard, sheet fed offset printing does not require the use of a highly blister resistant paper. It does, however, require surface smoothness, levelness, high paper gloss and high retained ink gloss. The coated paper produced by this example, when printed by commercial sheet fed offset methods, was of good quality. When compared to a commercially available coated paper of the same general character, it was noted that the coated paper of this example had surface smoothness, levelness, paper gloss and print quality equal to the commercial example even though the coated product of this example had a 1.5 lb. lower coating weight per ream. Although not important to sheet fed offset printing, the coated paper of this invention was 10% more porous than the commercial sample with which it was compared.

EXAMPLE 2

This example illustrates the preparation of an uncalendered, matte-finished paper for printing by either sheet fed or web fed offset printing.

An aqueous coating composition was prepared by conventional procedures from the following ingredients to a total solids level of 70.3% and a pH of 7.4.

| Materials | Dry Parts (by weight) |
|---|---|
| Pigments | |
| Kaolin clay (a 90 brightness, No. 1) grade coating clay) | 40 |
| Calcium carbonate (precipitated) | 15 |
| Hydrated alumina | 35 |
| Barium sulfate (precipitated) | 10 |
| Adhesives | |
| Sytrene butadiene copolymer[1] | 5 |
| Polyvinyl acetate homopolymer[2] | 5 |
| Hydroxyethylated starch ether (such as Penford Gum 290) | 2.5 |
| Additives | |
| Clay and barium sulfate dispersants (such as TSPP, i.e. tetrasodium pyrophosphate) | 0.05 |
| Carbonate and alumina dispersants (such as Calgon T, i.e. the sodium hexametaphosphate of Example 1) | 0.5 |
| Lubricant (such as calcium stearate) | 0.5 |
| Dyes, defoamers and antifoamers less than | 1.5 |

[1]A commercially available, carboxylated latex such as supplied by the Dow Chemical Company.
[2]A commercially available, polyvinyl acetate latex such as supplied by the Air Products Company.

The rheology of the coating composition of this example was between the maximum and minimum rheologies as shown in the drawing. The viscosity was 7140 cp. at 100° F.

This coating composition was used to coat a 66 lb. per ream prime coated base stock at a web speed of 1700 feet per minute. The paper was coated in an inverted blade coater in a single pass using two coating stations to thereby coat both sides of the paper web. Analysis of the coating composition as applied at the first coating station showed a solids content of 67.6 weight %, a pH of 7.4 and a viscosity of 4440 cp. at 133° F. The solids level at the second coating station was 68.6% by weight. At both of the coating stations, a 0.012 inch thick blade was used, which blade was backed with a 0.025 inch backing blade, the two blades being offset by a ⅛ inch overlap. The blade pressure at the first coating station was 7.5 lbs. per lineal inch and the blade pressure at the second coating station was 5.15 lbs. per lineal inch. The final weight of the coated paper was 81 lbs.

EXAMPLE 3

This example illustrates the preparation of a moderately supercalendered high-gloss offset enamel paper for use in printing by the web offset printing method.

An aqueous coating composition was prepared by conventional methods from the following ingredients in the relative amounts indicated below. The solids content, after screening, was 69.4% by weight, the pH was 7.5 and the viscosity was 7800 cp. at 120° F. Rheology was within the limits shown in the drawing.

| Materials | Dry Parts (by weight) |
|---|---|
| Pigments | |
| Kaolin clay (a No. 2 grade coating clay) | 60 |
| Precipitated calcium carbonate | 30 |
| Titanium dioxide (coating grade) | 10 |
| Adhesives | |
| Polyvinyl acetate homopolymer[1] | 10 |
| Hydroxyethylated starch ether (such as Penford Gum 290) | 2.5 |
| Additives | |
| Clay dispersant (such as TSPP) | 0.09 |
| Carbonate and titanium dispersants (such as Calgon T) | 0.4 |
| Lubricant (such as calcium stearate) | 1.67 |
| Dyes, defoamers, antifoamers, preservatives less than | 1.5 |

[1]A commercially available, polyvinyl acetate latex such as supplied by the Air Products Company.

This coating composition was applied to a 55 lb. per ream prime coated base stock at a coating speed of 1,400 feet per minute and, subsequently, at 2,100 feet per minute. An inverted blade coater having two coating stations was used to coat both sides of the paper in a single pass. The coating composition was sampled at each of the coating stations and the solids contents were, in both instances, 67.8% by weight. The pH was 7.1 and the viscosity was 7,800 cp. at 120° F. The blades were both 0.025 inches thick. The blade pressure at the first coating station was 6.0 lbs. per lineal inch (i.e. "pli") and the blade pressure at the second coating station was 3.65–4.35 lbs. per lineal inch. The total weight of the coated paper was 70 lbs. per ream. The coated paper was then moderately supercalendered.

By comparison with coated paper of this same grade produced in the same manner from similar coating compositions used at conventional solids levels in inverted blade coaters, paper produced according to this example had a substantially more level surface prior to being supercalendered. Consequently, excessive calendering pressures were not required to develop the very high paper gloss required of a paper of this particular grade. The advantages of coating the base stock in the manner described herein (as contrasted to conventional coating in the same coating apparatus) was observed in terms of improved smoothness, increased porosity, ease of finishing and retained ink gloss.

EXAMPLE 4

This example illustrates the preparation of a high bulk enamel. This product is a lightly supercalendered, high-gloss enamel having approximately 20% greater thickness than conventional enamels of similar paper and coating weights.

This coated paper was prepared in an inverted blade coating machine having two coating stations to thereby coat both sides of a moving web of paper in a single pass. The aqueous coating composition used in this example was prepared by conventional methods from the following ingredients in the proportions indicated.

| Materials | Dry Parts (by weight) |
|---|---|
| Pigments | |
| Kaolin clay (a 90 brightness, No. 1 grade coating clay) | 40 |
| Kaolin clay (a No. 2 grade coating clay) | 40 |
| Precipitated calcium carbonate | 20 |
| Adhesives | |
| Styrene/butadiene copolymer[1] | 7.3 |
| Styrene acrylic copolymer[2] | 5.7 |
| Hydroxyethylated starch ether | 2.5 |
| Additives | |
| Clay dispersant (such as TSPP) | 0.08 |
| Carbonate dispersant (such as Calgon T) | 0.2 |
| Lubricant (such as triglycerides of animal fatty acid) | 2.0 |
| Defoamers, antifoamers, dyes, preservatives less than | 0.5 |

[1]A commercially available carboxylated latex such as supplied by the Dow Chemical Company.
[2]A commercially available latex such as supplied by the Union Carbide Corporation.

In this example, the base stock was a special high-bulking 63 lbs./ream base stock (surface sized but not prime coated). The web speed was 1,385 feet per minute and the blades were 0.025 inches thick. The blade pressures at the two coating stations were 6.0 lbs. per lineal inch. The coating composition (as screened) had a solids content of 69.3 weight % and a viscosity of 12,000 cp. at 133° F. The pH was 7.2. The solids contents as measured at each of the two coating stations were 67.5% and 67.3%, respectively. The final weight of the coated paper was 79 lbs. per ream. Supercalendering was accomplished with as little pressure as possible. The resulting high-bulk enamel had an equal gloss and greater bulk than conventional paper coated to the same total coating weight and finished by more severe supercalendering (required to obtain the necessary gloss).

EXAMPLES 5–8

These four laboratory examples demonstrate the value of high solids coatings (with proper viscosity and rheology) over a wide range of pigment and adhesive combinations. Experience has shown that the laboratory data are indicative of the results which can be expected when the paper is coated on production blade coaters at high speeds.

Four aqueous coating compositions were prepared in the laboratory in accordance with standard practice. Coating formulae are given in Table II. Each coating was applied in a Time-Life laboratory coater to regular 55 lbs. prime coated base stock for offset, at two solids levels; 70% (the present process) and 65% (conventional). The coated papers were supercalendered under identical conditions, and tested for physical properties. The test results are shown in Table III. The viscosity and rheology of these aqueous coating compositions were within the limits set forth herein.

Porosity values record the ability of air to pass through a sheet of paper, and this is one of the major criteria in establishing blister resistance which is so important for web fed offset printing. It is not, however, the only factor. It is an established fact that blistering of web offset papers occurs when the vapor pressure of the moisture inherent in the paper exceeds the strength of the paper. The West Linn Blister Test accurately simulates web offset press conditions. A thin film of varnish is applied to both surfaces of a sheet of paper and dried. The varnished sample is then transported through a heating chamber. By varying the length of time a sample dwells in the heating chamber or by varying the heating conditions, blistering can be induced. Obviously the greater the dwell time and/or the hotter the chamber necessary to induce blistering, the greater the blister resistance.

TABLE II

COATING FORMULAE FOR EXAMPLES & THEIR RESPECTIVE CONTROLS

| Materials (Dry Parts) | Example 5 | 6 | 7 | 8 |
|---|---|---|---|---|
| A. PIGMENTS: | | | | |
| Kaolin Clay (No. 2 coating grade) | 70 | 85 | 75 | 75 |
| Calcium Carbonate (Precipitated) | 20 | 15 | 25 | 25 |
| Titanium Dioxide | 10 | — | — | — |
| Total Pigment | 100 | 100 | 100 | 100 |
| B. ADHESIVES: | | | | |
| Styrene/butadiene Copolymer[1] | 12 | 12 | 12 | 12 |
| Acrylic Polymer[2] | — | — | 3 | — |
| Modified Starch[3] | 2.5 | — | — | 1.5 |
| Modified Starch[3] | — | 3 | — | — |
| Polyvinyl Alcohol[4] | — | — | — | 1.5 |
| C. ADDITIVES: | | | | |
| Tetrasodium Pyrophosphate | 0.07 | 0.09 | 0.08 | 0.08 |
| Sodium Hexametaphosphate | 0.4 | 0.15 | 0.25 | 0.125 |
| Lubricant[5] | 1.0 | 1.0 | 1.0 | 1.0 |
| Antifoamer[6] | 0.2 | 0.2 | 0.2 | 0.2 |
| Defoamer[7] | 0.034 | 0.034 | 0.034 | 0.034 |
| Ammonium Hydroxide | — | — | — | — |
| Insolubilizer[8] | — | — | — | — |
| Sodium Hydroxide | — | 0.04 | — | — |

[1]latex such as a carboxylated latex supplied by Dow Chemical Co.
[2]latex such as an alkali swellable acrylic emulsion supplied by Rohm & Haas Co.
[3]hydroxylated starch ether such as supplied by Pennick & Ford Co.
[4]hydrolized polyvinyl alcohol such as supplied by Air Products Company.
[5]such as calcium stearate or triglycerides of higher fat acids (e.g. oleic acid)
[6]such as supplied by Nopco Chemical Co.
[7]such as supplied by Hercules Powder Co.
[8]such as methylated methylol melamine resin supplied by Monsanto Chemical Co.

TABLE III

COATING RESULTS

| | Example 5 High Clay | | Example 6 High Starch | | Example 7 All Synthetic | | Example 8 Polyvinyl Alcohol | |
|---|---|---|---|---|---|---|---|---|
| Solids of Application, % | 70 | 65 | 70 | 65 | 70 | 65 | 70 | 65 |
| Basis Weight (lbs./ream 25×38-500) | 72.3 | 71.5 | 72.3 | 71.5 | 71.8 | 70.6 | 71.5 | 70.1 |
| KBB Size, Sec. | 12 | 6 | 9 | 10 | 10 | 9 | 9 | 6 |
| Gurley Porosity, sec./100 cc. | 5800 | 6500 | 3800 | 4800 | 4500 | 5100 | 4400 | 5800 |

TABLE III-continued

| COATING RESULTS | | Example 5 High Clay | | Example 6 High Starch | | Example 7 All Synthetic | | Example 8 Polyvinyl Alcohol | |
|---|---|---|---|---|---|---|---|---|---|
| Ash, % | | 27.7 | 27.7 | 28.1 | 28.0 | 27.7 | 27.2 | 26.8 | 26.9 |
| Caliper, Mils. | | 30.7 | 3.7 | 3.7 | 3.7 | 3.8 | 3.8 | 3.8 | 3.8 |
| Brightness, % | | 80.8 | 81.1 | 79.3 | 79.8 | 79.6 | 79.8 | 79.9 | 80.0 |
| Opacity, % | | 96.0 | 96.1 | 96.0 | 96.2 | 96.0 | 96.0 | 96.0 | 95.5 |
| Bekk Smoothness, Sec. | F. | 725 | 575 | 700 | 625 | 900 | 650 | 650 | 550 |
| | W. | 650 | 475 | 600 | 475 | 775 | 550 | 625 | 450 |
| IGT Pick, No. 7 Ink | F. | 90 | 130 | 110 | 100 | 125 | 145 | 140 | 160 |
| | W. | 125 | 200 | 140 | 130 | 160 | 170 | 190 | 190 |
| Paper Gloss, % | F. | 63 | 55 | 57 | 50 | 66 | 55 | 60 | 52 |
| | W. | 67 | 58 | 58 | 51 | 68 | 58 | 61 | 55 |
| K&N Ink Brightness, % | F. | 73 | 72 | 69 | 70 | 74 | 75 | 78 | 75 |
| | W. | 73 | 74 | 71 | 72 | 76 | 75 | 79 | 77 |
| Blue Ink Gloss, % | F. | 87 | 87 | 90 | 84 | 93 | 88 | 92 | 86 |
| | W. | 90 | 88 | 92 | 87 | 92 | 89 | 91 | 85 |
| West Linn Blister Resistance Oven Dwell Time, Sec. | | 0.70 | 0.65 | 0.85 | 0.70 | 0.50* | −0.50* | 0.75 | 0.65 |

*0.50 seconds dwell time is the lower practical limit of the test. The high solids sample did not blister at this point but the low solids sample did.

The results in Table II permit the following conclusions:

Ash Content

The ash data show only slight variations in coat weight within a particular example.

Gurley Porosity

The porosity figures show the advantage of high solids over conventional solids in each example. Porosity improvements ranged from 10.8% with Example 5 to 24.1% with Example 8.

Bekk Smoothness

Each of the four examples show a significantly higher surface smoothness at high solids than at conventional solids levels. Improvements range from a maximum of 38.9% to a minimum of 10.7% with an average improvement of 23.8%.

Paper Gloss

This test also shows the advantage of high solids coating. All examples show better gloss at high solids than at conventional solids. Maximum improvement was 16.8%, minimum improvement 9.8%, with the average being 12.9%.

Blister Resistance

This test shows that the blister resistance of the high solids coatings is greater than the conventional solids coatings in each case. A change in oven dwell time of 0.05 seconds is considered significant.

This series of examples demonstrates exceptionally well, the advantages of applying the coatings at high solids. When properly formulated to produce usable viscosity and rheology, a unique blend of coated paper properties results. This blend of properties is shown to be exceptional surface smoothness and easy finishing while improving the openness of the coated paper.

With respect to the preceding Examples, the Kaolin clay, precipitated calcium carbonate, hydrated alumina, barium sulfate, and titanium dioxide pigments were all obtained from commercial sources and are more particularly identified as follows:

Kaolin Clay Pigment

"No. 1" grade (commercially designated "Premier" grade, similar to TAPPI "gloss" grade): 92–94% finer than 2 microns, equivalent spherical diameter (esd); "No. 2" grade (commercially designated "KCS" grade, similar to TAPPI "standard machine coating" grade): 80–82% finer than 2 microns, esd.

Precipitated Calcium Carbonate Pigment

"Purecal", type O (available from Wyandotte), particle size range: 0.10–0.35 microns.

Barium Sulfate (precipitated) Pigment

Blanc fixe Powder N, average particle size: 1.4 microns.

Titanium Dioxide Pigment

"Titanox" A-WD (available for National Lead Co.), particle size distribution: 0% greater than 1.0 microns, 97% in the range of 0.2–1.0 micron, 3% less than 0.15 micron.

Hydrated Alumina Pigment

"Hydral" paper grade alumina (available from Alcoa), particle size distribution (by esd, wt.%): 89% less than 2 microns, 48% less than 1 micron, 8% less than 0.5 micron.

As will be clear from the foregoing disclosure, all of the above pigments are "fine" pigments in that the pigment particles average less than 2 microns, esd. The clay and hydrated alumina pigments were plate-like in nature, i.e. the major amount of particles had an aspect ratio of about 9 or 10:1.

EXAMPLE 9

The following pigment formulation was found to be particularly suitable for coating heavy paper products, which normally would be double-coated.

| Pigment | Dry Parts (by weight) |
|---|---|
| Kaolin clay (at least 80 wt. % finer than 2 microns, esd) | 60 |
| Titanium dioxide (100% less than 1 micron, esd) | 20 |
| Water ground limestone (Coarse pigment, average particle size 2.5 microns, esd) | 10 |
| Blanc fixe powder (precipitated barium sulfate, average particle size about 1.4 microns) | 10 |

The average particle size of the pigment was 0.75 micron, esd.

The adhesive component was selected so as to maintain the viscosity and rheology within the limits of this invention; thus, 14 parts by weight of carboxylated butadiene-styrene latex (available from Dow Chemical Co.) were added to the pigment component along with the usual conventional additives (lubricants, defoamers, etc.), and no starch or modified starch was used in the adhesive component. Aqueous coating compositions were prepared from the pigment, adhesive, and additives in the conventional manner to provide a total solids levels, of 73.0 wt.%. The G.E. Brightness, gloss, smoothness, porosity, and other indicators of good quality for the resulting coated paper were comparable to the previous Examples.

EXAMPLE 10

The following pigment formulation was found to be suitable for coating bleached paperboard.

| Pigment | Dry Parts (by weight) |
|---|---|
| No. 2 Grade Kaolin Clay (82–84 wt. % finer than 2 microns, esd) | 80 |
| Water ground limestone (coarse pigment, average particle size 2.5 microns, esd) | 20 |
| Carboxylated butadiene-styrene | 12 |
| Tetrasodium pyrophosphate | 0.075 |
| Defoamer | 0.034 |

The solids level successfully used was 73.0% by weight. The resulting product was 180 pound coated paperboard (24 in.×36 in., 500 sheet basis), and similar improvements in quality were noted as compared to conventional puddle blade coatings, e.g. those applied at 60–65 wt. % solids.

These high solids experiments confirm that pigment quality is generally a function of particle shape and size. The superior pigments are usually plate-like (lamellar) in shape and/or finer than 2 microns (esd) in size. The preferred "coarse" ground limestone pigments generally comprise about 20%–60% (e.g. 50%) by weight particles smaller than 2 microns, esd. Thus, at least about 90% by weight of the pigment for these extra-high solids compositions comprises either plate-like particles or particles finer than 2 microns, esd. including the 2–10% ground limestone particles which are in this fine particle size range.

What is claimed is:

1. A process for coating paper which comprises:

(a) introducing into a blade coating station of a blade-coating apparatus, an aqueous coating composition with a solids content within the range of 67–73 weight-%, a Brookfield viscosity of 1000 to 30,000 centipoise at 122° F., and a rheology within the maximum and minimum rheologies shown in the drawing, said coating composition consisting essentially of:

(1) paper coating pigment material comprising at least one-third by weight of clay particles, at least 80% by weight of the remaining two-thirds of said pigment material comprising pigment particles smaller than 2 microns equivalent spherical diameter as determined by settling techniques, at least 90% by weight of said pigment material being selected from the group of pigments consisting of clay, calcium carbonate, titanium dioxide, hydrated alumina, barium sulphate, ground limestone, and mixtures thereof; and (2) from 5 to 30 parts by weight of water soluble or water dispersible, non-protein adhesive per 100 parts by weight of said pigment material, all on a dry basis;

(b) maintaining said aqueous coating composition at said blade coating station at or above the minimum rheology shown in the drawing and at a solids level within the said range of 67–73 weight-% while passing a paper web at a speed of at least 500 feet per minute past said blade coating station and applying said aqueous coating composition to said moving web at said blade coating station; the rheology maintained at said blade coating station being selected to maximize porosity and blister resistance properties of the resulting coated paper without producing blade scratches on said coated paper; and (c) recovering a coated paper web with porosity and blister resistance properties superior to a coated web coated in the same manner but with a relatively lower rheology and relatively lower solids content, as compared to the rheology and solids content maintained at said blade coating station.

2. A process according to claim 1 wherein said remaining two-thirds of said pigment material is selected from the group of pigments consisting of clay, titanium dioxide, precipitated calcium carbonate, and mixtures thereof.

3. The process according to claim 1 wherein said paper coating pigment material comprises 40–85% by weight plate-like clay particles averaging less than 2 microns equivalent spherical diameter, at least 80% by weight of said plate-like clay particles being finer than 2 microns equivalent spherical diameter.

4. The process of claim 3 wherein the remaining 60–15% by weight of said paper coating pigment is at least one fine pigment averaging less than 2 microns equivalent spherical diameter, said fine pigment being selected from the group consisting of calcium carbonate, barium sulfate, titanium dioxide, and hydrated alumina.

5. The process of claim 1 wherein said coating pigment consists essentially of pigments with an average equivalent spherical diameter no greater than 1.5 microns.

6. The process according to claim 1 wherein said solids content is 68–72% and said speed in said step (a) is 1,500–3,500 feet per minute.

7. The process according to claim 1 wherein said pigment material comprises:

(a) at least one-third by weight of plate-like clay particles having an average equivalent spherical diameter less than 2 microns, (b) up to two-thirds by weight of plate-like hydrated alumina particles averaging less than 2 microns in equivalent spherical diameter, and (c) up to two-thirds by weight of a pigment selected from the group consisting of calcium carbonate, barium sulfate, and titanium dioxide particles and mixtures thereof averaging less than 2 microns in equivalent spherical diameter, at least 80% by weight of said particles having an equivalent spherical diameter less than 2 microns and at lest 60% by weight having an equivalent spherical diameter less than 1 micron.

8. A process according to claim 1 wherein said pigment material comprises at least about 75% by weight of plate-like clay particles.

9. The process according to claim 1 wherein said aqueous coating composition is substantially free of protein adhesive.

10. The process of claim 9 wherein said non-protein adhesive includes at least one adhesive selected from the group consisting of starch, modified starch, styrene/butydiene latex, polyvinyl alcohol, vinyl chloride polymer, vinyl acetate polymer, and acrylic polymer.

11. The process according to claim 10 wherein said non-protein adhesive includes 1.5–4.5 parts of starch per 100 parts of pigment and from 7–15 parts of styrene/-butadiene polymer per 100 parts of pigment, all on a dry basis, and wherein the total solids level of said coating composition is 68–73 weight %.

12. The process of claim 10 wherein:

(a) the Brookfield viscosity of said coating composition when determined at 50° C., is 3,000 to 8,000 cps;

(b) the temperature at which the coating composition is applied is 40°–60° C.; and (c) the coated paper web is recovered after both sides of the web have been coated in a single pass.

13. The process of claim 12 wherein the rheology of said coating composition is approximately the optimum rheology as shown in Table I.

14. The process of claim 9 wherein said non-protein adhesive includes acrylic polymer.

15. The process of claim 10 wherein said non-protein adhesive includes vinyl acetate polymer.

16. The process of claim 11 wherein the coated paper web is supercalendered.

17. The process according to claim 1 wherein said solids content is greater than 70% by weight.

18. A process for coating paper which comprises:

(a) preparing a plurality of aqueous coating compositions differing from one another in solids content, each coating composition having a solids content within the range of 67–73 weight-% and a Brookfield viscosity of 1,000 to 30,000 centipoise at 122° F.; each coating composition consisting essentially of:

(1) paper coating pigment material comprising at least one-third by weight of clay particles, at least 80% by weight of the remaining two-thirds of said pigment material comprising pigment particles smaller than 2 microns equivalent spherical diameter as determined by settling techniques, at least 90% by weight of said pigment material being selected from the group of pigments consisting of clay, calcium carbonate, titanium dioxide, hydrated alumina, barium sulphate, ground limestone, and mixtures thereof; and (2) from 5 to 30 parts by weight of water soluble or water dispersible, non-protein adhesive per 100 parts by weight of said pigment material, all on a dry basis;

(b) selecting a said aqueous coating composition from among said plurality of coating compositions in accordance with the maximum and minimum rheologies shown in the drawing to maximize porosity and blister resistance properties in the coated paper without producing blade scratches during blade coating;

(c) introducing essentially the selected aqueous coating composition into a blade coating station of a blade coating apparatus;

(d) maintaining the said selected aqueous coating composition at a said blade coating station at or above the minimum rheology shown in the drawing and at a solids level above 67 weight-% while passing a paper web at a speed of at least 500 feet per minute past said blade coating station and applying the said selected aqueous coating composition to said moving web at said blade coating station;

(e) recovering a paper coated web essentially free of blade scratches which has porosity and blister resistance properties superior to a coated paper web coated in the same manner but with a relatively lower rheology and relatively lower solids content as compared to the rheology and solids content maintained at said blade coating station.

19. Coated paper produced by the process of claim 1.

* * * * *

UNITED STATES PATENT AND TRADEMARK OFFICE

CERTIFICATE OF CORRECTION

PATENT NO. : 4,154,899

DATED : May 15, 1979

INVENTOR(S) : Robert V. Hershey & Gerald M. Hein

It is certified that error appears in the above-identified patent and that said Letters Patent are hereby corrected as shown below:

Column 4, line 3, for "95% wt. %" read --95 wt. %--.
Column 4, line 23, for "and" read --an--.
Column 4, line 39, for "facillitate" read --facilitate--.
Column 12, line 5, for "formulae" read --formulas--.
Column 12, line 32, for "FORMULAE" read --FORMULAS--.
Column 12, line 47, under Ex. 8, for "0.125" read --0.25--.
Column 12, line 50, under Ex. 7, for "—" read --0.7--.
Column 12, line 54, for "hydroxylated" read --hydroxyethylated--.
Column 13, line 7, first column under Ex. 5, for "30.7" read --3.7--.
Column 14, line 29, for "for" read --from--.
Column 15, line 5, for "levels" read --level--.
Column 16, line 60, for "lest" read --least--.
Column 17, line 4, for "butydiene" read --butadiene--.

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*